United States Patent [19]

Bishara

[11] Patent Number: 4,523,531

[45] Date of Patent: Jun. 18, 1985

[54] MODULAR FURNACE LINING HAVING MECHANICALLY INTERLOCKING ATTACHMENT MEANS

[75] Inventor: William Bishara, Niagara Falls, N.Y.

[73] Assignee: Kennecott Corporation, Cleveland, Ohio

[21] Appl. No.: 582,402

[22] Filed: Feb. 22, 1984

[51] Int. Cl.[3] ..... F23M 5/00

[52] U.S. Cl. ..... 110/336; 52/506; 52/509; 432/248

[58] Field of Search ..... 110/336, 332, 338; 52/509, 506; 432/248, 250

[56] References Cited

U.S. PATENT DOCUMENTS

| | | | |
|---|---|---|---|
| 3,940,244 | 2/1976 | Sander et al. | 432/247 |
| 4,117,644 | 10/1978 | Weinar | 52/509 |
| 4,152,877 | 5/1979 | Green | 52/509 |
| 4,246,852 | 1/1981 | Werych | 110/336 |
| 4,324,602 | 4/1982 | Davis et al. | 52/227 |
| 4,449,345 | 5/1984 | Hounsel et al. | 110/336 |

*Primary Examiner*—Henry C. Yuen

*Attorney, Agent, or Firm*—David M. Ronyak

[57] ABSTRACT

A furnace lining in which insulation fibers are formed into mats which in turn are formed into prefabricated modules each of which is installed by forcing it into interlocking engagement with a matingly configured clip that has been previously secured to an interior surface of the furnace. Each insulation module includes a tray having a bottom portion including a plurality of openings capable of interlocking engagement with projections of a complementary clip. The tray further includes projections which secure rods that pass through the ceramic fiber insulation to secure it to the tray. A preferred tool for the installation of such a furnace lining is also described and the method of installation of such a lining.

7 Claims, 6 Drawing Figures

MODULAR FURNACE LINING HAVING MECHANICALLY INTERLOCKING ATTACHMENT MEANS

BACKGROUND OF THE INVENTION

The present invention relates to modular ceramic fiber insulation systems and more particularly to the components of a modular system in which the insulation modules are easily and securely installed simply by forcing them into interlocking engagement with a complementary clip that has been previously secured to an interior surface of a furnace.

Modular systems for insulation of furnaces, kilns and the like are not of themselves novel. Many different modular systems in which modules formed in part of ceramic fiber blanket or mat are employed have been proposed. Many of these have been successfully employed and enjoy great commercial success. However there remains a need for a ceramic fiber modular insulation system or furnace lining which can be easily and rapidly installed with minimum usage of special tools by a labor force not having highly specialized skills in which each module remains installed until it is necessary to replace that module due to damage or wear out. It is of course desired to meet these objectives in as economical a manner as possible, the total economy of a system necessarily taking into account the cost of the component materials and subassemblies and the cost of labor to manufacture and install the lining and the insulating effectiveness and life of the resulting installation.

Examples of known modular ceramic fiber insulation systems include the following:

U.S. Pat. No. 3,940,244 to Sauder et al. discloses an insulation module for lining an interior wall of a high temperature chamber comprising first and second blocks of high temperature insulating material each of said first and second blocks comprising a plurality of strips of resilient fiber insulation positioned adjacent to each other in side-by-side relation with the fibers of said resilient strips being arranged in planes substantially perpendicular to the plane of said respective relatively hot faces, the module including a backing sheet of a material such as expanded metal having openings throughout which engage with a configured arcuate washer and a stud to retain the module securely to the furnace wall. The washer is sized and configured such that its in-prongs will lock into place onto one diamond of the expanded metal backing. The modules described in this patent may also be attached by a stud welding technique more fully described in U.S. Pat. No. 3,706,870 to Robert A. Sauder et al. Alternatively, when the open mesh type backing plate is employed, an explosive impact type dry pin fastener technique may also be employed to fasten the module to the furnace wall.

U.S. Pat. No. 3,832,815 to Balaz et al. discloses ceramic fiber insulation for lining furnaces in which the insulation fibers are formed into prefabricated modules by compression members located at the outer cold side end portion of the insulation layer and by which the modules are mounted in position of use on the furnace wall. Each module is fabricated of layers of high temperature ceramic fiber blanket material which are disposed substantially perpendicular to the hot face of the furnace lining. The layers are compressed during assembly into a resilient bundle. The compression forces inside each module are resisted by pins threaded substantially perpendicularly through the blanket layers and disposed near the outer cooler face of the module that is remote from the interior of the furnace. The retainer members comprise elongated strips of expanded metal having a length corresponding to the width of the assembled strips and are formed to be L-shape in cross-section. These retainer members are secured to the furnace wall, for example, by a plurality of pins which extend through the furnace exterior shell. The base portion of the retainer members are deemed to be not essential.

U.S. Pat. No. 3,952,470 to Byrd, Jr. disloses a modular ceramic fiber insulation wherein a folded insulating blanket of refractory fibrous material is provided with a support mounted lengthwise and imbedded within a fold in the blanket to support the blanket, and a mounting means which includes suspension arm which extends through the folds of the blanket from the support beam to an attachment beam for mounting with the wall of the furnace, the attachment beam having openings formed therein for passage of connecting members therethrough to attach the attachment beam to the wall of the furnace. The main support beam is attached to the furnace wall in conventional manner, i.e. by welding or the use of screws, bolts and the like.

U.S. Pat. No. 4,339,902 to Cimochowski et al. discloses a modular thermal insulation device formed of folded fibrous insulating blanket and a metallic attachment structure adapted to be secured to a wall of a furnace, kiln or like structure. A bar is imbedded in a fold of the blanket. The bar is attached by a connecter to the main beam is in the form of a C-shaped channel which is mounted to a furnace wall by first placing a flanged mounting clip against the furnace wall and then sliding the C-shaped attachment means over the clip so the flanges of the beam engage the flanges of the mounting clip.

U.S. Pat. No. 4,381,634 to Hounsel et al. discloses the refractory ceramic fiber blanket module having a continuous strip of ceramic fiber folded into a number of layers in serpentine fashion. Certain of the folds contain support rods which engage a perpendicularly extending support rod which is inserted through the suspension tabs of a slide channel member which has a C-shaped cross-sectional configuration. The C-shaped slide channel engages a complementary attachment member that has been previously stud welded or otherwise attached to the inner surface of the furnace.

U.S. Pat. No. 4,120,641 to Myles discloses a ceramic fiber module which comprises a weldable (metallic or perforate refractory) backing and a number of ceramic fiber mats cemented to the backing by the edge of the mat so as to leave a portion of the backing accessible between mats or on their perimeter for welding. The weldable backing is welded to a metallic substrate preferably by use of spherical attachments.

U.S. Pat. No. 4,287,839 to Severin et al describes an apparatus for lining the inner walls of industrial furnaces with a plurality of insulating blocks, each block comprising an insulating mat which is folded in corrugated matter, the insulating mats being made of highly resistant material such as ceramic fibrous material. Each insulating mat is penetrated below the extreme ends of the folds by carrying bars which are affixed to lugs which are in turn joined to a base plate having on opposite sides webs that are bent outwards. The webs have holes for the purpose of joining adjacent insulating blocks by means of bolts. Also suspension hooks are attached to the base plate in a rotatable manner. The suspension hooks are hooked into or suspended from holding bars which are themselves suspended from U-shaped beams, e.g. beams of a furnace roof. This system permits replacement of individual defective insulating blocks from outside the furnace without interrupting its operation. The carrying bars penetrate the ceramic fiber mat layers substantially perpendicular to the planer faces of the ceramic fiber mat.

U.S. Pat. No. 4,324,602 to Davis et al describes the installation of thermal insulation modules in which the modules are affixed to the furnace wall by a chemical adhesive.

SUMMARY OF THE INVENTION

There is provided, according to an aspect of the present invention a furnace lining comprising:

a. a clip adapted to be fastened to a surface of a furnace, the clip including a projection which extends away from the surface of the furnace toward the interior of the furnace when the clip is installed;

b. a module including a hot face adapted to be presented to the interior of a furnace and a cold face adapted to be presented to a surface of a furnace, the module being formed of ceramic fiber insulation mat secured to a tray adjacent to the cold face of the module;

c. the tray and clip including between them means for interlocking engagement which are actuated solely by forcing the tray of the module towards the furnace wall while positioned over the projection of the clip.

According to another aspect of the invention there is provided a method of lining an interior of a furnace comprising:

a. fastening a clip which includes a flat base and a resilient projection extending at approximately right angles from the base to a furnace surface such that the resilient projection extends toward the interior of the furnace and away from the surface of the furnace;

b. positioning a module that includes a hot face adapted to be presented to the interior of the furnace and a cold face adapted to be presented to a surface of the furnace with its cold face over the previously mounted clip, the module being formed of a plurality of pieces of ceramic fiber insulation mat secured to a tray located on or adjacent the cold face of the module, the tray including means for interlocking engagement with a projection of the clip;

c. forcing the tray into engagement with the projections of the clip such that the projections of the clip protrude through the tray and interlockingly engage with the tray;

d. removing the force applied to engage the clip and tray.

BRIEF DESCRIPTION OF DRAWINGS

The invention will be more particularly described as to its preferred embodiments by reference to the accompanying drawing in which like parts are numbered alike.

DESCRIPTION OF PREFERRED EMBODIMENTS

Figure 2:
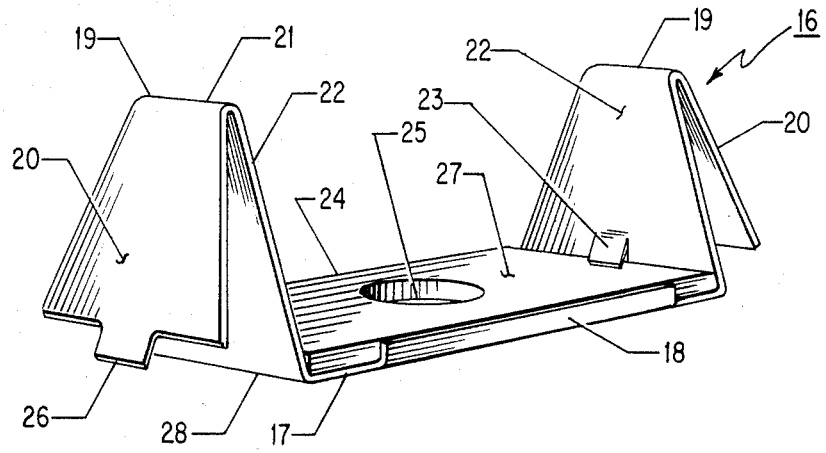
FIG. 2 is an enlarged perspective view of a preferred embodiment of a resilient clip according to the invention.
Figure 3:
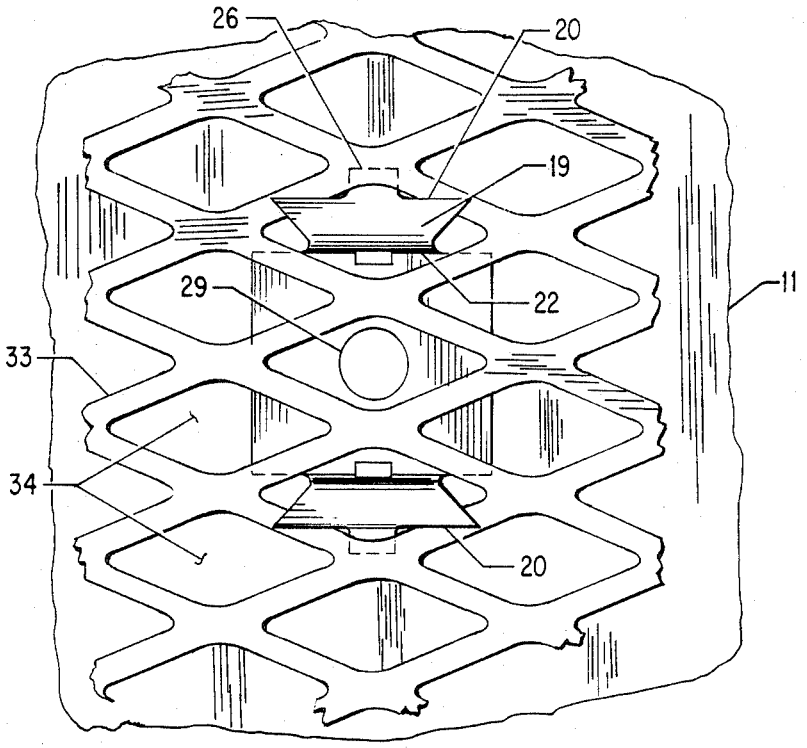
FIG. 3 is an enlarged schematic fragmentary plan view showing the interlocking engagement of a clip like that shown in FIG. 2 with the base of a tray like that shown in FIG. 1.
Figure 4:
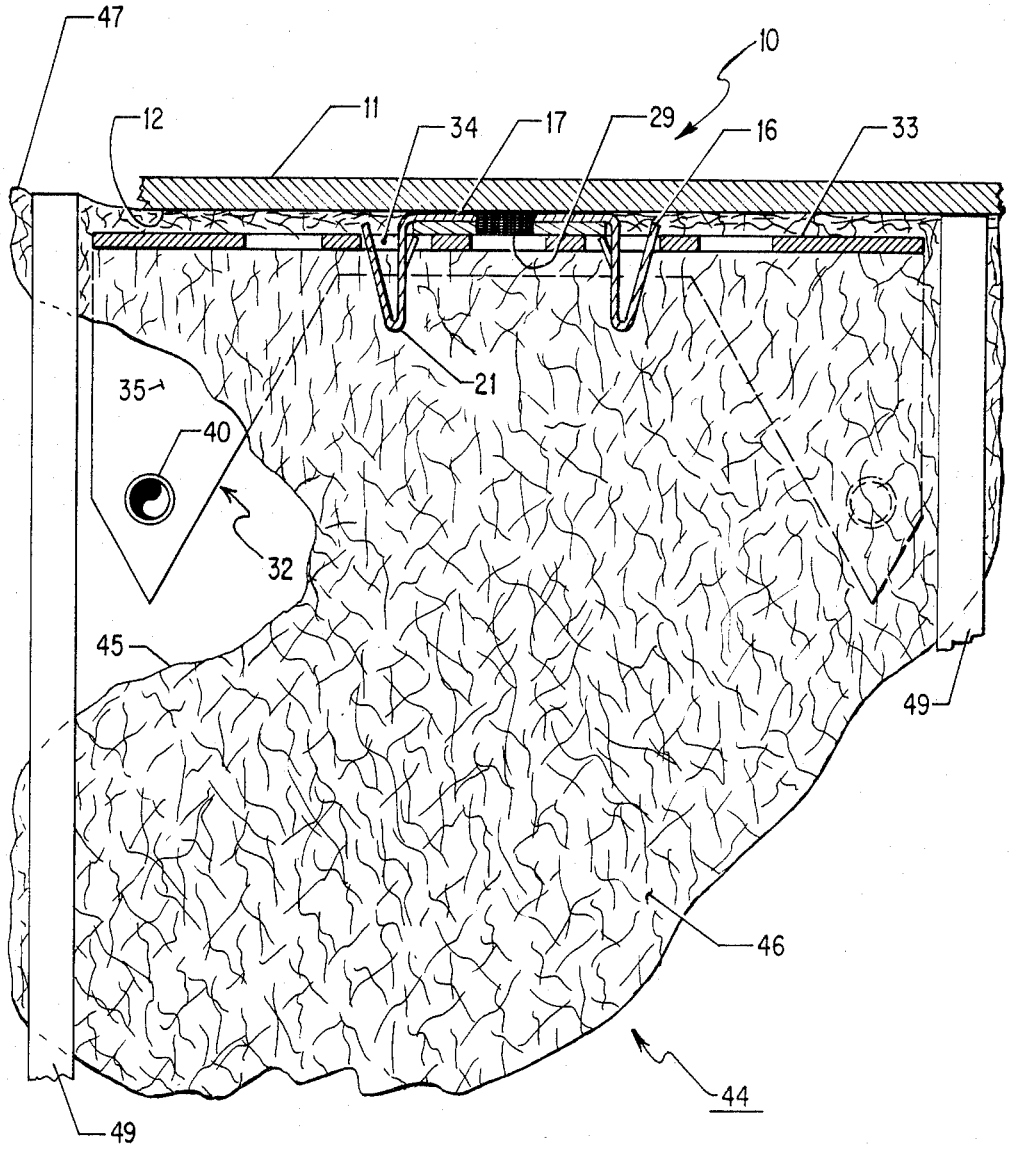
FIG. 4 is an elevational view partially in section and with portions broken away to illustrate internal structure of a furnace wall having a modular lining according to the invention.

A first and highly preferred embodiment according to the present invention of a modular furnace lining and its components is shown in FIGS. 1, 2, 3, and 4. In FIG. 4 there is shown a modular furnace lining 10. Modular furnace lining 10 includes a clip 16 which is secured to the interior surface 12 of a furnace wall 11, a ceramic fiber insulation module 44 which itself comprises a plurality of planar ceramic fiber mats 45 which are secured to a tray 32 by retaining members 40 which are threaded through the portions of ceramic fiber mat 45. The tray 32 and the module 44 include between them means for interlocking engagement which are actuated solely by forcing the tray of the module toward the furnace wall while positioned over the major projections 19 of the clip 16.

Figure 1:
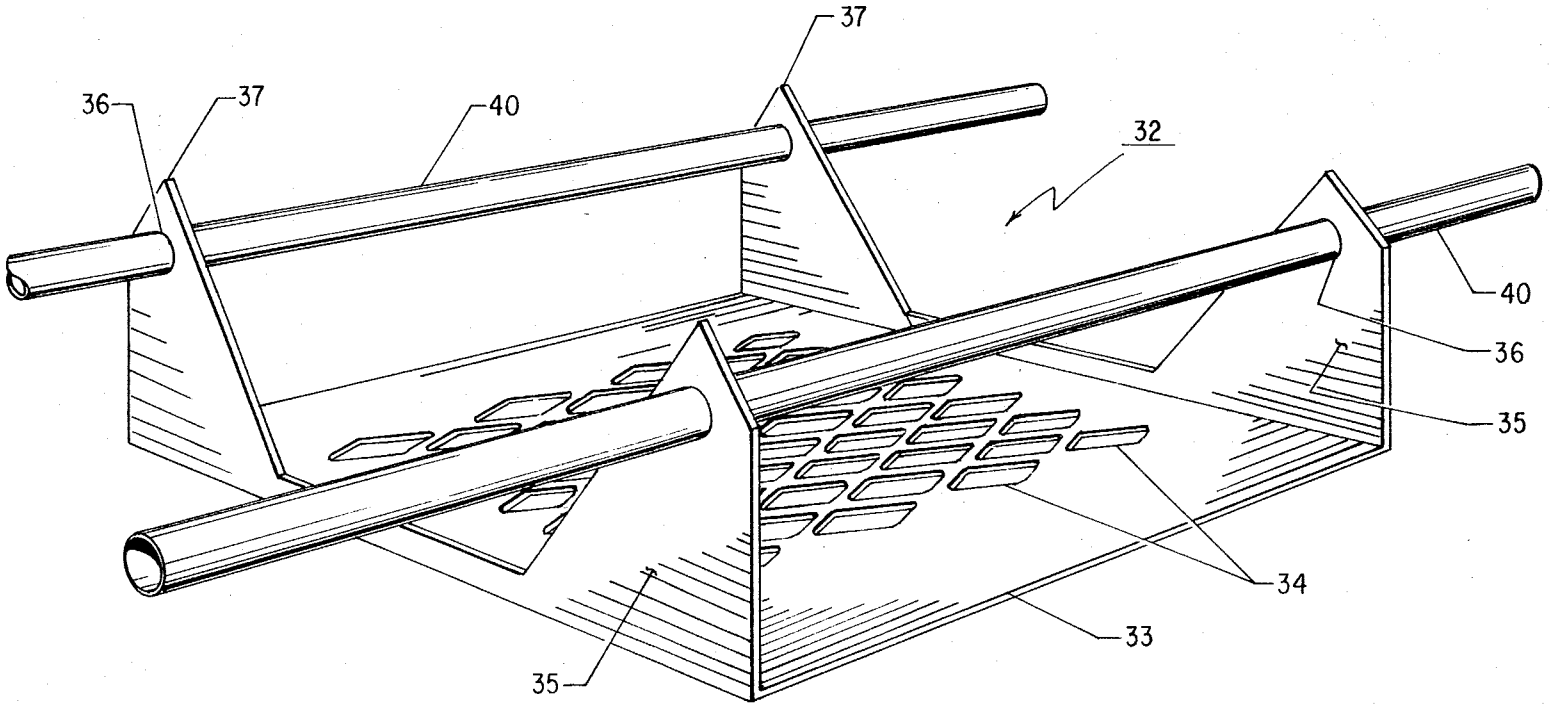
FIG. 1 is a perspective view of a tray and attachment rods according to the invention.

The tray 32 that is employed in a first embodiment of the invention as depicted in FIGS. 1–4 is shown in enlarged form in FIG. 1. Tray 32 includes a flat bottom portion 33 which includes a plurality of openings 34 which are of a size and shape and spacing to permit interlocking engagement with the resilient major projections 19 of clip 16 which is shown in detail in FIG. 2. The tray 32 includes at each of two opposite ends of its bottom portion 33 an end wall 35 each of which projects in the same direction approximately perpendicularly to the bottom portion 33. The end walls 35 include pointed projections 37 to facilitate insertion of the tray 32 into and parallel to the planar faces of the planar ceramic fiber mats 45. Each pointed projection 37 of each end wall 35 includes a bore 36 therethrough which is aligned with that of a projection located at the opposite end wall of the bottom portion 33 of tray 32. A retaining rod 40 extends through each aligned pair of bores 36 in end walls 35. These retaining rods are used to secure the ceramic fiber mats 45 to tray 32 to form a module 44. To save weight and material the retaining rods 40 are preferably formed by rolling flat sheet metal stock into tubular form. The rods may be slightly oversized so that they will be retained by friction when inserted in bores 36, although it is preferable to have the rods undersized to facilitate insertion through bores 36 of tray 32. Friction to retain the rods is generated by the compressed tray and ceramic fiber mats when a module is assembled and again when installed.

A prefered embodiment of a clip 16 according to the present invention is shown (enlarged) in FIG. 2. Clip 16 includes a flat centrally located base portion 17. Clip 16 has a front face 27 which is presented toward the interior of the furnace when the clip is installed. Flat base portion 17 of clip 16 also includes a rear face 28 which is adapted to be presented to the interior surface 12 of furnace wall 11 when installed. Clip 16 includes turned-up edges 18 which are integrally formed with flat base portion 17. Clip 16 includes a pair of major resilient V-shaped projections 19 extending from each of two opposite ends of the central base portion 17. These major resilient projections 19 are preferably integrally formed with flat base portion 17 from a single piece of sheet metal stock . Each major projection 19 of clip 16 includes a free leg 20 and an attached leg 22 which are angularly disposed relative to one another to form a V-shape with the closed end 21 of each major projection 19 protruding away from the interior surface 12 of furnace wall 11 when clip 16 is installed. The free leg 20 of each major V-shaped projection 19 is free to flex elastically toward the attached leg 22 of that V-shaped projection due to its slightly smaller length dimension as compared to that of attached leg 22. Attached leg 22 can also flex elastically about its junction with base portion 17 but much greater force is required because the width of the junction of attached leg 22 with base portion 17 is greater than that of the junction 21 of free leg 20 with attached leg 22. Each major projection 19 of clip 16 is also tapered such that the closed end 21 of each projection 19 is of lesser width or transverse dimension than the remainder of the free leg 20 and attached leg 22. This configuration facilitates initial location and penetration of the major resilient projections 19 relative to and through openings 34 provided in bottom 33 of tray 32. Clip 16 additionally includes on each attached leg 22 of each major projection 19 a resilient tine 23. Tines 23 cooperate with turned-up edges 18 to locate and retain a reinforcing plate 24 against flat base portion 17. A centrally located bore 25 through reinforcing plate 24 and flat base portion 17 of clip 16 is provided to facilitate attachment of clip 16 to a interior surface 12 of furnace wall 11. This attachment may be made in conventional manner for example, by welding, riveting, or use of a threaded fastener.

The manner in which clip 16 interlockingly engages bottom portion 33 of tray 32 is shown in detail in FIG. 3. Tray 32 is positioned over previously mounted clip 16 which is secured to the interior surface 12 of furnace wall 11 by stud weld 29. The resilient major projections 19 of clip 16 are presented toward openings 34 in tray bottom 33. When the tray bottom 33 is forced toward the surface 12 on which clip 16 is mounted, the resilient major projections 19 are caused to pass through openings 34 in tray bottom 33. Because the closed ends 21 of major projections 19 are of smaller area than the remainder of the resilient major projections, movement of the resilient major projections 19 into and through openings 34 is facilitated. When tray bottom 33 has been forced sufficiently close to the interior surface 12 of a furnace wall 11 to which clip 16 is fastened, the free legs 20 of major projections 19 spring back and extend over bottom portion 33 of tray 32. Each tab 26 on the free end of each free leg 20 projects generally in the plane of the leg to which it is attached away from the closed end of the Vee. Tabs 26 on the free ends of free legs 20 of major projections 19 cause the major projections to be self-locating relative to the diamond shaped openings 34 in tray bottom 33. Also, tabs 26 prevent the legs 20 and 22 of major projections 19 from spreading open under load directed away from the furnace wall. The free end of free legs 20 is in contact with that surface of the bottom portion 33 of tray 32 which faces the hot interior of the furnace; these act in concert to prevent removal of the tray and thus removal of a ceramic fiber insulation module such as module 44 without extreme distortion of clip 16, tray bottom 33 or both.

Insulation modules are formed of ceramic fiber insulation mat secured to a tray adjacent the cold face of the module. Each module has a cold face adapted to be presented to an interior surface of a furnace and a hot face adapted to be exposed to the hot interior of a furnace. Insulation module 44 is formed by taking a plurality of equal sized planar ceramic fiber mats 45, arranging them in an array such that their planar faces 46 are juxtaposed and positioned generally perpendicular to the bottom portion 33 of tray 32. A pair of retaining rods 40 are passed generally perpendicularly through the planes of mats 45 and bores 36 in end walls 35 of tray 32 to secure the mats 45 to tray 32. It is preferable to dimension retaining rods 40 such that their length is slightly less, e.g. one-fourth inch total, than the overall thickness of the array of stacked ceramic fiber mats which is penetrated thereby. The ceramic fiber mats 45 and particularly the outside ceramic fiber mats are retained in place in the module 44 prior to its installation by strips of tape 49. Ordinary plastic strapping tape may be employed for this purpose as a great deal of strength is not required. The tape should be removed after installation of the module. Any remaining tape burns off upon initial firing of the furnace in which the modules are installed.

Figure 5:
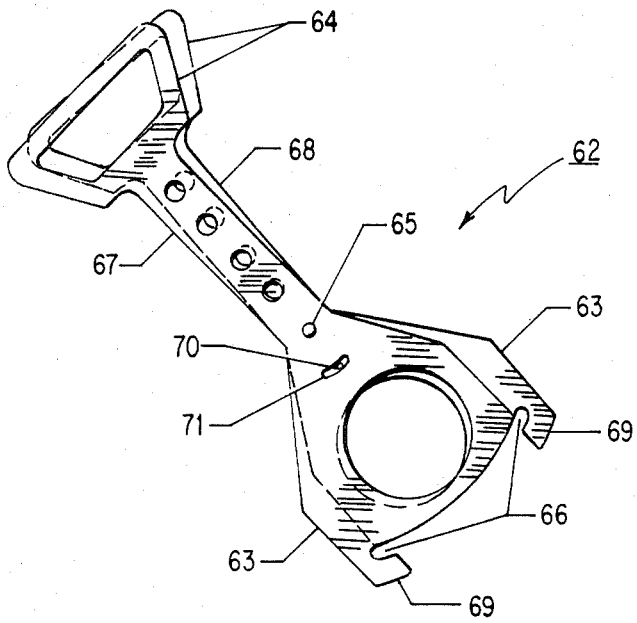
FIG. 5 is a plan view of a tool for use in installation of furnace lining according to the invention.

Module 44 may be secured to a previously installed clip 16 without damage to the module 44 by use of tool 62 as shown in FIG. 5. Tool 62 includes a pair of near mirror image lever arms 67 and 68 joined by a centrally located pivot 65. One end of each lever arm 67, 68 is in the form of a handle 64; the opposite end is in the form of a jaw 63. Jaws 63 are configured so as to engage and interlock with retaining rods 40 of module 44. Each jaw 63 includes a slot 66 dimensioned to complement the diameter of retaining rod 40. A slot 71 is provided in arm 67 which cooperates with limit pin 70 to limit the amount of angular movement of jaws 63 relative to one another. Jaws 63 of tool 62 are inserted between the layers of ceramic fiber mat 53 and operated so as to engage and lock on retaining rods 40. Jaws 63 are dimensioned such that a portion 69 of each extends beyond tubes 40 when engaged with tubes 40 and contacts bottom portion 33 of tray 32 such that the force required to install the module 44 is directed primarily through the tray bottom 33 rather than bearing entirely on retaining rods 40. These features enable the tray 32 and retaining rods 40 to be of lightweight metal and yet withstand the force necessary to interlockingly engage the module 44 with clip 16.

Figure 6:
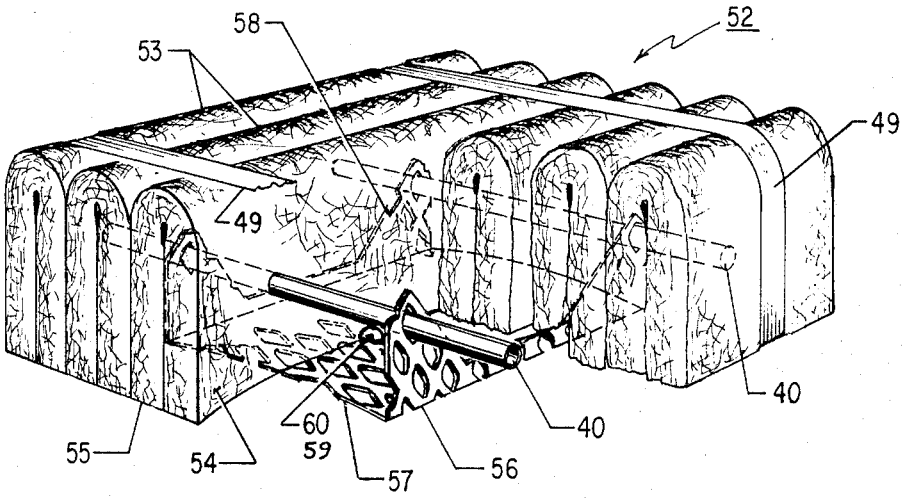
FIG. 6 is an isometric view partially broken away illustrating an alternate embodiment of a modular furnace lining and attachment means according to the invention.

In FIG. 6 there is shown an alternate embodiment of a ceramic fiber insulation module 52. As in the embodiment previously discussed module 52 includes a plurality of ceramic fiber mat portions 53 arranged in an array such that the planar faces 54 of adjacent mats 53 are juxtaposed. The planar faces 54 of mats 53 are generally perpendicular to the curved base 57 of tray 56. Tray 56 is formed of expanded sheet metal into a generally U-shaped cross-sectional configuration and includes a centrally located base 57 whose face that is adapted to be presented toward the hot interior of a furnace is convexly curved in that direction. Tray 56 includes a pair of spaced end walls 58 which are integrally formed of the expanded sheet metal with base 57. The ceramic fiber mats 53 are secured to tray 56 by passing a plurality of rods 40 perpendicularly through the planar ceramic fiber mats 53 and the end walls 58. While insulation module 52 may be employed in conjunction with a clip like clip 16, it may also be employed with a clip 59 which includes a pair of projections 60 in the configuration of hooks that open toward a furnace wall when clip 59 is secured to that furnace wall. Module 52 is installed by forcing curved base 57 of tray 56 toward the furnace wall over a previously installed clip 59 such that the hooked projections 60 of clip 59 protrude through the opening in the expanded metal of the curved base 57 and interlockingly engage with this curved base 57. Because base 57 is initially curved and desires to return to this curved configuration, base 57 remains firmly biased into engagement with the hooked projection 60 of clip 59 upon release of the installation force.

The clip, tray, and retaining rods in either of the embodiments shown and described are preferably formed of type 304 stainless steel to provide sufficient high temperature resistance and corrosion resistance to provide an adequate service life commensurate with that of the ceramic fiber of the furnace lining. Other metals or other materials may be employed provided that sufficient resistance to the intended service temperature and atmospheric conditions is inherent in the materials chosen.

The tray of each module is preferably recessed a slight amount, for example, ⅛ to 3/16 of an inch relative to that surface of the ceramic fiber mat portions presented to the tray so that upon installation the ceramic fiber mat portions will form a perimeter seal around the metal parts and against the interior surface of the furnace wall.

Should a module become damaged it may be readily replaced as follows. The ceramic fiber of the damaged module is torn away to expose the clip. The flexible major projections of the clip are flexed so as to release the tray from the clip. A new module is then installed over the same clip. If the clip is damaged e.g. by exposure to excessive heat due to loss of ceramic fiber insulation mat, the clip may be removed and a new clip installed in its place.

The foregoing description and embodiments are intended to illustrate the invention without limiting it thereby. It will be understood that various modifications can be made in the invention which are obvious from the embodiments which have been described in detail. These variations are intended to be included within the present specification and claims. Examples of such variations are the following. The clip could be formed with larger or smaller major resilient projections. The clip could be formed with a greater number of projections. The free ends of the major resilient projections could be in the form of the outline of a chevron whose points would overlap adjacent openings in the bottom of the metal tray to that opening through which the major resilient projection protrudes thus eliminating the need for tabs 26 as shown in FIGS. 2 and 3. This would be equivalent to forming tabs at the edges of the free ends of free legs 20 rather than a single tab at the center as shown in FIG. 2. The spacing and shape of the openings in the tray bottom could be varied to accommodate variations in the configuration of the clip. The clip could engage every third or every fourth or every fifth, etc. opening in the tray bottom rather than as shown. A greater or lesser quantity of retaining rods could be employed to secure the ceramic fiber mat portions to the tray. The ceramic fiber mat portions could be folded into U-shaped sections or in serpentine fashion prior to being secured to the tray by retaining rods. The fiber of the mats could be other than ceramic fiber.

What is claimed is:

1. A modular furnace lining comprising:

a. a clip having a centrally located base portion adapted to be fastened to a surface of a furnace, the clip including a pair of major resilient projections which extend away from its base portion and the interior surface of the furnace toward the interior of the furnace when the clip is installed;

b. a module including a hot face adapted to be presented to the interior of a furnace and a cold face adapted to be presented to an interior surface of a furnace, the module being formed of ceramic fiber insulation mat secured to a tray adjacent to the cold face of the module; said tray including a bottom portion having a plurality of openings of such size and arrangement that they are capable of interlocking engagement with the major projections of the clip;

c. resilient means for interlocking engagement included between the tray and the clip which is actuated solely by positioning the tray of the module over the projections of the clip and forcing the tray of the module towards the base portion of the clip; said major projections being elastically flexed as the tray is forced thereover.

2. The lining of claim 1 wherein the clip includes a major resilient V-shaped projection extending from each of two opposite ends of the central base portion, with the closed end of the V protruding away from the furnace surface when the clip is installed, the free leg of the V-shaped projection being free to flex elastically toward the other leg of the V-shaped projection; the tray having a flat bottom portion including a plurality of openings of a size and shape and spacing to permit interlocking engagement with the V-shaped projections of the clip, the tray including at each of two opposite ends of its bottom portion an end wall projecting in the same direction, approximately perpendicularly to the bottom portion, at least one projection at each end having a bore therethrough aligned with that of a projection located at the opposite end of the bottom portion; and a retaining rod passing through the ceramic fiber mat to secure the mat and a bore of each end wall of the tray to secure the mat to the tray.

3. A furnace lining according to claim 2 wherein the tray includes at each of its two opposite ends of its bottom portion two spaced apart, pointed projections integrally formed of the end walls, each projection having a bore therethrough aligned with that of a complementary projection located at the opposite end wall of the tray; a plurality of planar ceramic fiber mats each having two planar faces and a plurality of edge faces, the mats being arranged in an aray such that the planar faces of adjacent mats are juxtaposed, the planar faces of the mats being generally perpendicular to the bottom portion of the tray such that an edge face of each mat is presented to the hot interior of the furnace upon installation; a pair of retaining rods passing generally perpendicularly through the planes of the mats and the bores of the end wall projections to secure the mats to the tray.

4. A furnace lining according to claim 2 wherein the tray is recessed relative to the ceramic fiber mat portions at the cold face of the module such that a perimeter seal against the furnace wall is formed around the tray by the ceramic fiber mat portions upon installation.

5. A furnace lining according to claim 1, wherein the clip is formed of stamped sheet metal and its flat bottom portion includes longitudinally extending turned up edges which cooperate with resilient tines located on the major resilient projections to secure a reinforcing plate which reinforces the central bottom or base portion of the clip; the clip further including at each free end of each free leg of each major projection and approximately centered thereon an integrally formed tab which projects generally in the plane of the leg of the major projection to which it is attached away from the closed end of the Vee.

6. A modular furnace lining comprising:

a. a clip adapted to be fastened to a surface of a furnace, the clip including a projection which extends away from the surface of the furnace toward the interior of the furnace when the clip is installed;

b. a module including a hot face adapted to be presented to the interior of a furnace and a cold face adapted to be presented to a surface of a furnace, the module being formed of ceramic fiber insulation mat secured to a tray adjacent to the cold face of the module; said tray being of generally U-shaped cross-sectional configuration and including a centrally located base whose face which is adapted to be presented toward the hot interior of the furnace is convexly curved and a pair of spaced end walls which are adapted to project toward the hot interior of the furnace from opposite edges of the base; said tray base including a plurality of openings of such size and arrangement that they are capable of interlocking engagement with the projections of the clip; and c. resilient means for interlocking engagement included between the tray and the clip which may be actuated solely by positioning the tray of the module over the projections of the clip and forcing the tray of the module towards the clip; said tray base being adapted to flex toward the clip upon application of sufficient force to cause the projections of the clip to project through the tray base and upon release of the applied force to spring back and thereby interlockingly engage the tray base with the projections of the clip.

7. A method of lining an interior surface of a furnace with a modular furnace lining comprising: a clip having a centrally located base portion adapted to be fastened to the surface of a furnace, the clip including a pair of major resilient projections which extend away from its base portion and the interior surface of the furnace toward the interior of the furnace when the clip is installed; a module including a hot face adapted to be presented to the interior of a furnace and a cold face adapted to presented to an interior surface of a furnace, the module being formed of ceramic fiber insulation mat secured to a tray adjacent to the cold face of the module; said tray including a bottom portion having a plurality of openings of such size and arrangement that they are capable of interlocking engagement with the major projections of the clip; resilient means for interlocking engagement included between the tray and the clip which is actuated solely by positioning the tray of the module over the projections of the clip and forcing the tray of the module toward the base portion of the clip; said major projections being elastically flexed as the tray is forced thereover; the method of lining comprising:

a. fastening said clip by its base portion to said furnace surface such that said pair of resilient projections extend toward the interior of said furnace and away from said surface of said furnace to which said base portion of said clip is attached;

b. positioning said module with its hot face presented to the interior of said furnace and its cold face presented to said resilient projections of said previously mounted clip;

c. forcing said tray of said module toward said base portion of said clip, thereby causing said major resilient projections of said clip to be elastically flexed and said major resilient projections of said clip to protrude through said tray and interlockingly engage said tray; and d. removing the force applied to cause interlocking engagement of said clip and said tray.

* * * * *